US005954227A

United States Patent [19]

Moore et al.

[11] Patent Number: 5,954,227

[45] Date of Patent: Sep. 21, 1999

[54] METHOD AND APPARATUS FOR INDIVIDUALLY DISPENSING STORED ARTICLES

[75] Inventors: Harry O. Moore, Charlotte; David L. Furr, III, Indian Trail, both of N.C.

[73] Assignee: Harry O. Moore and Chris Combis, Charlotte, N.C.

[21] Appl. No.: 09/181,004

[22] Filed: Oct. 28, 1998

Related U.S. Application Data

[60] Provisional application No. 60/063,421, Oct. 28, 1997.

[51] Int. Cl.[6] ..... G07F 11/12

[52] U.S. Cl. ..... 221/103; 221/151; 221/155; 221/213; 221/214

[58] Field of Search ..... 221/103, 108, 221/116, 111, 151, 155, 215, 213, 214

[56] References Cited

U.S. PATENT DOCUMENTS

| | | | |
|---|---|---|---|
| 2,576,636 | 11/1951 | Opgenorth | 221/213 |
| 2,858,047 | 10/1958 | Williams et al. | 221/213 |
| 2,876,884 | 3/1959 | Ray | 221/214 |
| 3,180,518 | 4/1965 | Roser | 221/155 |
| 3,708,087 | 1/1973 | Schonthal | 221/110 |
| 5,000,346 | 3/1991 | Moore et al. | 221/215 |
| 5,209,336 | 5/1993 | Heltzen et al. | 221/103 |
| 5,791,511 | 8/1998 | Lowing | 221/155 |

*Primary Examiner*—H. Grant Skaggs

*Attorney, Agent, or Firm*—Dougherty & Associates

[57] ABSTRACT

A vending apparatus for individually vending an article from a set of articles and for vending a display article after the set of articles has been depleted. The apparatus includes a rack for vertical storage of a stack of newspapers, and a bracket for positioning a display newspaper in a front window of the vending apparatus. The invented vending apparatus includes means for individually dispensing newspapers from the stack of newspapers and includes means for discharging the display newspaper after the stack of newspapers has been depleted. The dispensing means includes a dispensing bar having spikes for engaging the front newspaper in the stack of newspapers. The dispensing bar is protected by a dispensing bar cover that encases the dispensing bar and spikes when the door is in an opened position for loading newspapers. The cover has an extension with a distal roller for engaging a guide on the housing. When the door is closed, the guide displaces the cover away from the dispensing bar thereby exposing the spikes. The dispensing means also includes a pneumatic cylinder which slows the return of the handle thereby providing sufficient time for a vended newspaper to exit the interior chamber formed by the housing. Finally, the discharging means includes a discharge bar that is mounted to the rear support plate on the rack. After the stack of newspapers has been depleted, the spikes on the dispensing bar engage the exposed discharge bar causes an arm to pivot. The arm includes a hook to support the displayed newspaper until the arm is pivoted to a point where the hook releases the displayed newspaper to a catch.

19 Claims, 3 Drawing Sheets

METHOD AND APPARATUS FOR INDIVIDUALLY DISPENSING STORED ARTICLES

CROSS-REFERENCE TO RELATED APPLICATION

This application claims the benefit of U.S. Provisional Application No. 60/063,421 filed Oct. 28, 1997.

FIELD OF THE INVENTION

The present invention relates to an apparatus for dispensing articles. More particularly, the invention relates to an apparatus for individually vending an article, such as a newspaper, from a set of articles and for vending a display article after the set of articles has been depleted.

BACKGROUND OF THE INVENTION

Newspaper vending machines are pervasive in every city for providing the latest newspaper edition. The newspaper vending machines come in various sizes and shapes, depending on the particular size and shape of the newspaper contained therein. Additionally, newspaper vending machines bear various indicia of advertisements, especially advertisements that identify the newspaper contained in the vending machine.

Newspaper publishers and distributors have a substantial financial stake in the sales of newspapers from vending machines. The common newspaper vending machine has a coin receipt for a purchaser to insert coins and open a front door of the vending machine. The purchaser then has access to the interior of the vending machine and may select a newspaper. Unfortunately, the purchaser also has access to all of the newspapers contained within the vending machine. Newspapers that are taken from the vending machine without a corresponding payment presents a burden to the newspaper publishers and/or the particular route managers assigned to the newspaper vending machine because of the lost revenue from those newspapers.

Additionally, the route managers have an intimate knowledge of the average number of newspapers vended by each specific vending machine. This allows the route manager to preplan for the number of newspapers required to be vended along a route and attempt to minimize the route manager's loss of sales. When a purchaser acquires more than the purchaser's paid share of newspapers, revenue is lost and creates a substantial variation in the route manager's newspaper requirements.

Numerous attempts have been made to create newspaper vending machines that individually dispense newspapers. An example of such a machine is disclosed in U.S. Pat. No. 5,000,346 (hereinafter referred to as "the '346 machine"). The '346 machine allows newspapers of various sizes to be individually vended each time a user deposits an appropriate amount of money into a money collection device. Despite numerous advantages over other conventional newspaper vending machines, the '346 machine has several disadvantages which limit its commercial practicability. For example, the '346 machine does not effectively utilize a display copy that is positioned in a traditional manner. A display copy of a newspaper is used both to promote the newspaper by showing the front page and to visually indicate to a potential purchaser that the newspaper vending machine is out of newspapers. Additionally, the '346 machine requires a pivotally attached top cover in order to gain access to the interior of the '346 machine. The '346 machine is thus limited to top opening vending machines.

Therefore, a need exists for a vending apparatus that effectively utilizes a display article. Further needed is a vending apparatus that is capable of individually dispensing articles from a set of stored articles. Further needed is a vending apparatus that is capable of dispensing the display article after the set of stored articles has been depleted. Further needed is a vending apparatus that is easily adapted and incorporated with conventional vending machines for individually dispensing articles from a set of stored articles and that is capable of dispensing the display article after the set of stored articles has been depleted.

SUMMARY OF THE INVENTION

The present invention is a vending apparatus for individually dispensing an article from a set of stored articles. The present invention also effectively and efficiently utilizes a display article that is dispensable after the set of stored articles has been depleted. The invented vending apparatus is best exemplified, but is not limited to, the vending of newspapers. The present invention provides a commercially practical means for easily adapting and incorporating a vending apparatus to conventional vending machines for individually dispensing an article from a set of articles and for discharging a display article after the set of articles has been depleted.

The present invention comprises a housing having a lockable front door positionable on a pedestal base, a rack mountable on the inner surface of the front door, means for dispensing a single article positioned on the rack and means for discharging a display article coupled to the rack. The housing provides storage for a set of unvended articles, such as newspapers and magazines. The front door is pivotally attached to an open front side of the housing to pivot between an opened position and a closed position. The rack extends into the interior of the housing and allows articles to be oriented in a vertical position for vending. The means for dispensing a single article from a set of articles is positioned on the rack.

The bottom of the front door is preferably hinged to the bottom side of the housing. A portion of the front door is substantially transparent to provide a prospective purchaser with an enticing view of the display article. In a preferred embodiment, the front door includes a window. A slot is formed in the bottom side of the housing and positioned posterior to the front door hinge and proximal to the front end of the bottom side of the housing. The slot allows an article to be vended from the interior of the housing and pass through the slot. A catch is preferably mounted to the housing and positioned below the slot to receive a vended article. Once the vended article exits the interior of the housing, the article rests in the catch until it is removed by the purchaser.

The rack comprises a base for positioning the stack of articles thereon, a pair of opposing side walls attached to opposing ends of the base, a bracket attached to the pair of side walls and a spring loaded rear support plate for biasing a set of articles toward the bracket. The base, the pair of side walls, the bracket and the rear support plate form an enclosure having variable volume for containing the set of articles. The bracket is preferably mounted to the front door, and the front door and the bracket form a channel for a display article to temporarily reside therein. The distance between the pair of walls of the rack is preferably a distance corresponding to the width of an article desired to be dispensed by the vending machine.

The base comprises a roller assembly positioned between the pair of side walls for engagement with the set of articles, a central channel, a slide movably positioned in the central channel for receiving the rear support plate and a spring/pulley mechanism coupled to the base, the slide and the housing. The spring/pulley mechanism regulates the movement of the rear support plate so that the rear support plate moves away from the front door when the front door is opened and pivoted away from the housing. Similarly, when the front door is closed and pivoted towards the housing, the rack is pivoted towards the interior of the housing thereby causing the rear support plate to move forward towards the front door. As the articles are dispensed, the spring/pulley mechanism biases the rear support plate against the remaining articles and towards the front door and the bracket.

The rack further includes a front support plate that extends upward from the front end of the base of the rack and is positioned adjacent the slot formed in the housing. The front support plate prevents the set of articles from being dispensed until a purchaser buys an article. In particular, the front support plate holds the set of articles on the rack until the articles are vended.

The means for dispensing a single article comprises a three-stage lift mechanism, a pivot rod coupled to the lift mechanism, a cam mechanism coupled to both the pivot rod and the lift mechanism and a handle connected to the cam mechanism for actuating the cam mechanism and thereby actuate the lift mechanism. The lift mechanism contacts an adjacent article in the set of articles and displaces the adjacent article during vending. The lift mechanism comprises a dispensing bar that is positioned between the bracket and an adjacent article when articles are loaded in the rack and two sets of movably interconnected lift arms connected to the ends of the dispensing bar. The cam mechanism includes a cam arm attached to the handle, a pivot arm connected to both the cam arm and the pivot rod and a pair of cams attached to the ends of the pivot arm.

The dispensing bar includes at least one spike extend radially outward from the dispensing bar for contacting and securely moving an article. The dispensing means further includes a dispensing bar cover that is pivotally mounted on the bracket and movably positioned over the dispensing bar and spikes. In a preferred embodiment, the dispensing bar cover includes an extension attached to one end of the dispensing bar cover and a roller positioned on a distal end of the extension, and the corresponding side of the housing has a guide mounted thereon for engaging the roller. When the front door is moved to a closed position, the roller engages the guide and displaces the dispensing bar cover away from the dispensing bar to allow the dispensing bar to engage an adjacent article. A coil spring preferably interconnects the roller and the rack for biasing the roller against the guide. Accordingly, when the front door is moved to an opened position, the dispensing bar cover is pulled back over the dispensing bar by the spring.

Each set of movably interconnected lift arms is positioned on the exterior side of each side wall and preferably pivotally attached to the exterior side of each side wall. Each cam of the cam mechanism engages a lift arm of a corresponding set of lift arms. When a purchaser inserts coins to purchase an article, the purchaser draws or pivots the handle away from the front door. When the handle is drawn away or pulled down, the cam mechanism engages the lift mechanism. As the handle is progressively pivoted away from the front door, the cam mechanism and lift mechanism proceed through three stages. In a first stage, the cam mechanism actuates the lifting mechanism to displace the dispensing bar towards the interior chamber of the housing thereby allowing the spikes on the dispensing bar to engage an adjacent article. Continued movement of the handle causes the dispensing bar to displace in an upward or vertical direction and proceed through a second stage. As the dispensing bar is displaced vertically, the adjacent article is likewise displaced vertically with the dispensing bar. In a third stage, the cam mechanism actuates the lifting mechanism to displace the dispensing bar away from the interior chamber of the housing to position the adjacent article over the slot. The dispensing bar is then abruptly displaced away from the interior chamber, and the article is allowed to drop through the slot. At this point, the handle is completely pulled down.

The handle is pivotally attached to the front door and preferably incorporates a tension spring at a hinge attachment to the front door thereby biasing the handle against the front door. In a preferred embodiment, the cam mechanism is attached to a pneumatic cylinder to provide a predetermined resistance against the handle while the handle pivots towards the front door. Accordingly, as the handle is released and allowed to pivot towards the front door and the interior chamber of the housing, the dispensing bar is gently placed against a next adjacent article.

The means for discharging a display article comprises an arm having a hook portion at one end of the arm, an engaging portion at the other end and a discharge bar movably positioned on the back of the rear support plate. The arm is pivotally mounted on the interior surface of the bracket which faces the interior chamber of the housing. The hook portion of the arm is received through a slot formed in the bracket and engages the display article positioned on the exterior side of the bracket. The hook portion of the arm supports the display article and prevents the display article from dropping through the slot.

The engaging portion extends away from the bracket and is aligned with the discharge bar. The discharge bar pivots the arm of the discharging means to dispense the display article. When no articles remain in the rack, the discharge bar pivots the engaging portion of the arm which in turn pivots the hook portion of the arm of the discharging means. As the hook portion is pivoted away from the display article, the display article is allowed to fall through the slot.

The invented apparatus may additionally include a currency or coin receiving mechanism for accepting a purchaser's inserted coins or currency. In a preferred embodiment, the coin or currency accepter is mounted to the interior side of the front door.

The front door may additionally include a locking mechanism for securing the front door to the housing of the vending machine. The locking mechanism may be a conventional lock and key device.

OBJECTS OF THE INVENTION

The principal object of the present invention is to provide an apparatus for individually vending articles.

Another object of the present invention is to provide an apparatus having a dispensing means for individually vending an article from a set of articles and having a discharging means for vending a display article after the set of articles has been depleted.

Another, more particular, object of the present invention is to provide an article vending machine having a dispensing means for individually vending an article from a set of articles and for preventing the dispensing means from tearing an article positioned adjacent to the dispensing means during the loading of the articles.

Another object of the present invention is to provide a newspaper vending machine having a dispensing means for individually vending a newspaper from a set of newspapers and a discharging means for vending a display newspaper after the set of newspapers has been depleted.

BRIEF DESCRIPTION OF THE DRAWINGS

The foregoing and other objects will become more readily apparent by referring to the following detailed description and the appended drawings in which.

DETAILED DESCRIPTION

Figure 1:
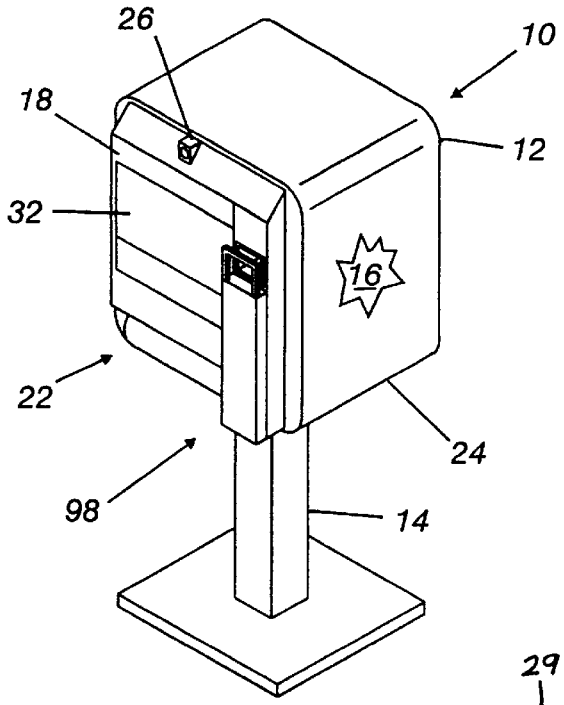
FIG. 1 is a perspective view of a vending apparatus in accordance with the present invention.

Referring now to the drawings, and in particular to FIG. 1, the present invention is an apparatus, shown generally at 10, for vending a single article from a set of articles and for vending a display article after the set of articles has been depleted.

In a preferred embodiment of the present invention, the invented apparatus 10 comprises a housing 12 having a front door 18, a rack, shown generally at 38 (FIG. 2), mounted to the inner surface of the front door 18, means for dispensing a single article, shown generally at 70 (FIGS. 3 and 4), positioned on the rack 38 and means for discharging a display article, shown generally at 106 (FIG. 2), connected to the rack 38. The housing 12 has five sides that form an interior chamber 16, as best shown in FIG. 1, for the storage of a set or stack of unvended articles, such as newspapers and magazines. The front door 18 is positioned in an open front side of the housing 12 and the bottom, shown generally at 22, of the front door 18 is preferably hinged to the bottom side 24 of the housing 12 to pivot between an open position and a closed position.

Figure 3:
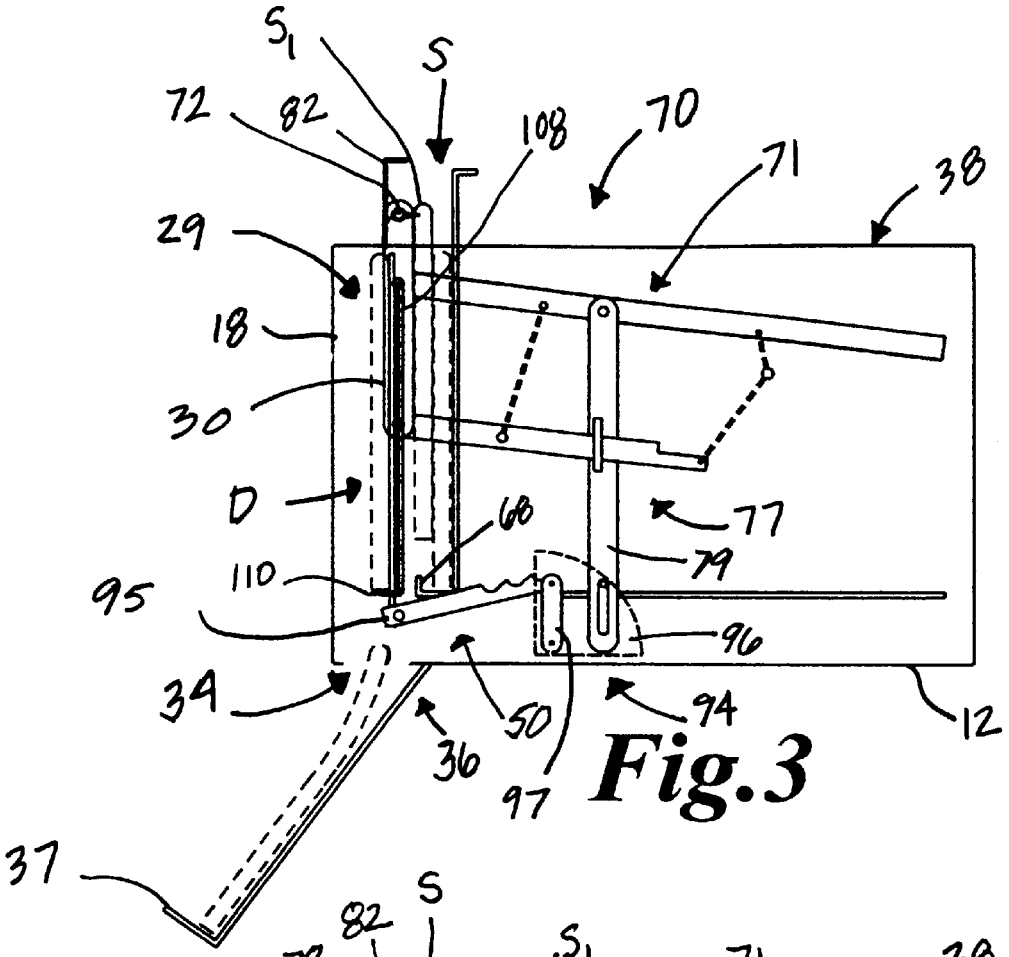
FIG. 3 is a cross-sectional side view of a portion of the vending apparatus in a vending position in accordance with the present invention.
Figure 4:
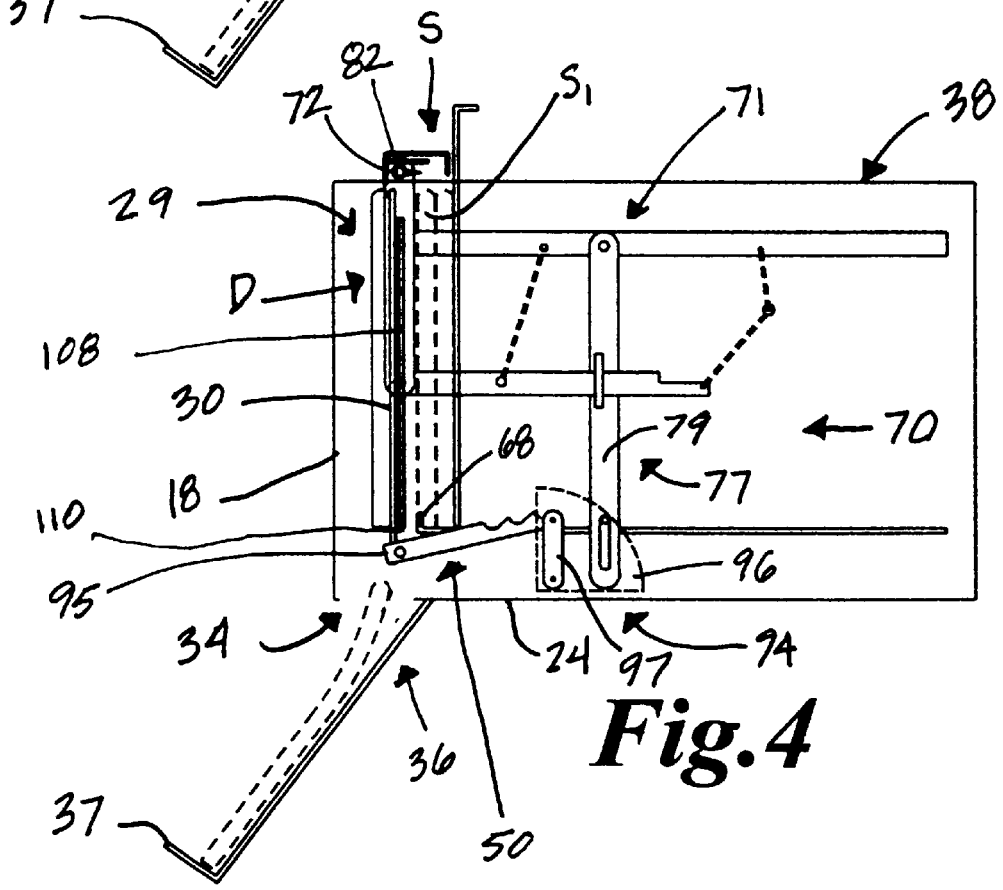
FIG. 4 is a cross-sectional side view of a portion of the vending apparatus in an initial vending position in accordance with the present invention.

The housing 12 may vary in size and volume to correspond to a desired article size and a pre-determined number of articles for dispensing from the invented apparatus 10. The housing is preferably mounted on a pedestal base 14, but other conventional base types may be used, including but not limited to foot supports and columns. Additionally, the exterior of the housing 12 may have different indicia of advertisements for promoting the sale of articles from the invented apparatus 10. The front door 18 provides access to the interior chamber 16 of the housing 12 and preferably has a locking mechanism 26 to prevent an unauthorized opening of the door 18. The rack 38, extends into the interior chamber 16 of the housing 12 and allows articles to temporarily be stored in the housing and preferably allows articles to be vertically stacked with the fold of the article oriented downward. As best shown in FIGS. 3 and 4, the means for dispensing a single article 70, vends an article from a set of articles S positioned on the rack 38. The means for discharging a display article 106 vends an article D positioned between the front door 18 of the housing and the rack 38. A portion 32 of the front door 18 is generally transparent and provides a prospective purchaser with an enticing view of the display article D.

A slot, shown generally at 34 (FIGS. 3 and 4), is positioned posterior to the hinged front door 18 and at a front end, shown generally at 36, of the bottom side 24 of the housing 12. The slot 34 allows an article to be vended from the interior chamber 16 of the housing 12. A catch 37 is mounted to the bottom side 24 of the housing 12 and is positioned below the slot 34 to receive a vended article, such as a newspaper. Once the article exits the interior chamber 16, it rests in the catch 37 until it is removed by the purchaser.

Figure 2:
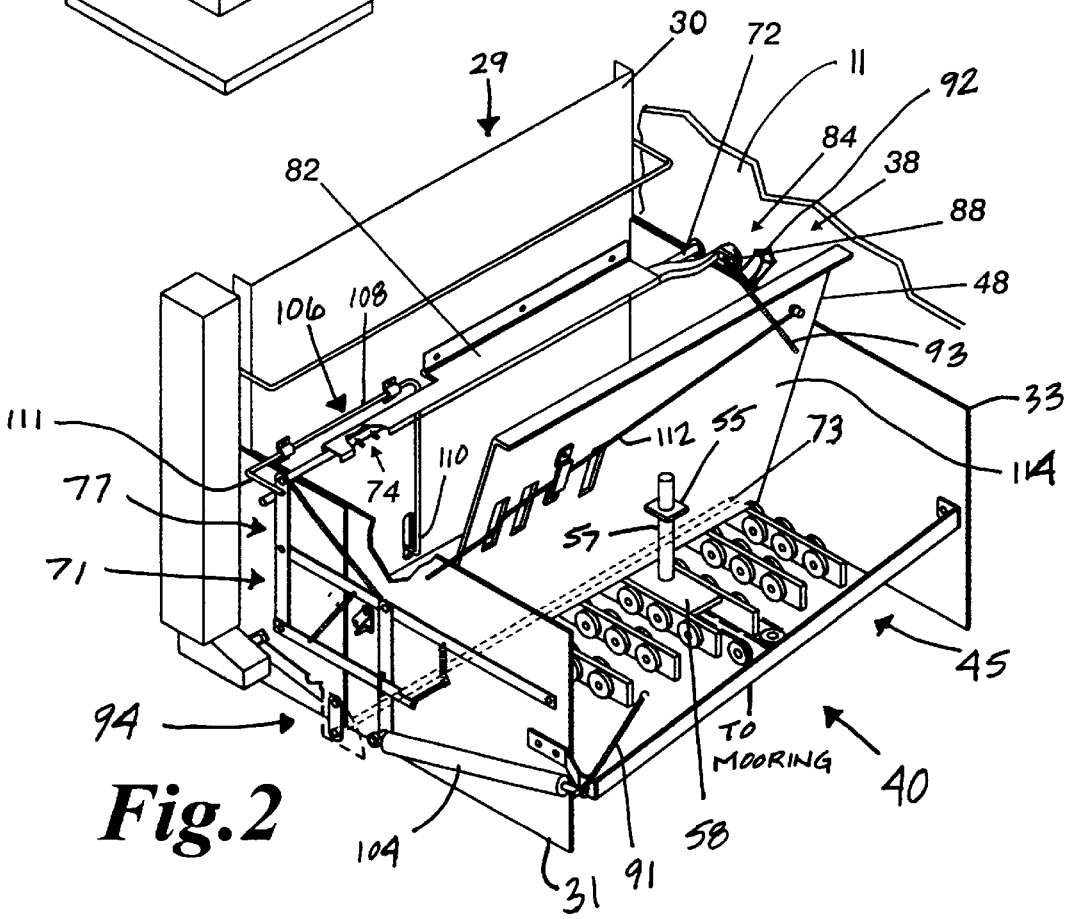
FIG. 2 is a perspective view of the interior structure of the vending apparatus in accordance with the present invention.

FIG. 2 is a perspective view of the interior structure of the vending apparatus 10 in accordance with the present invention. The rack 38 comprises a base, shown generally at 40, the bracket 30, a pair of side walls 31, 33 attached to the opposing ends of the bracket 30, a spring-loaded rear support plate 48 for biasing a set of articles, a roller assembly, shown generally at 45 (FIG. 5), positioned on the base 40 of the rack 38 and a front support plate 68 attached to the base 40. The pair of side walls 31, 33, the bracket 30, the roller assembly 45 and the rear support plate 48 from an enclosure having variable size for containing the set of articles. As previously mentioned, the bracket 30 is mounted to the front door 18 and forms a channel, shown generally at 29, for a display article D to temporarily reside therein, as best shown in FIG. 3. As the front door 18 is pivoted to an opened position for loading articles in the invented apparatus 10, the rack 38 likewise pivots outward with the front door 18. The distance between the pair of side walls 31, 33 is preferably the width of the article desired to be contained within the invented apparatus 10. A coil spring 91 may be interconnected to the rack 38 and the housing 12 to bias the rack towards the interior chamber 16 of the housing 12.

Figure 5:
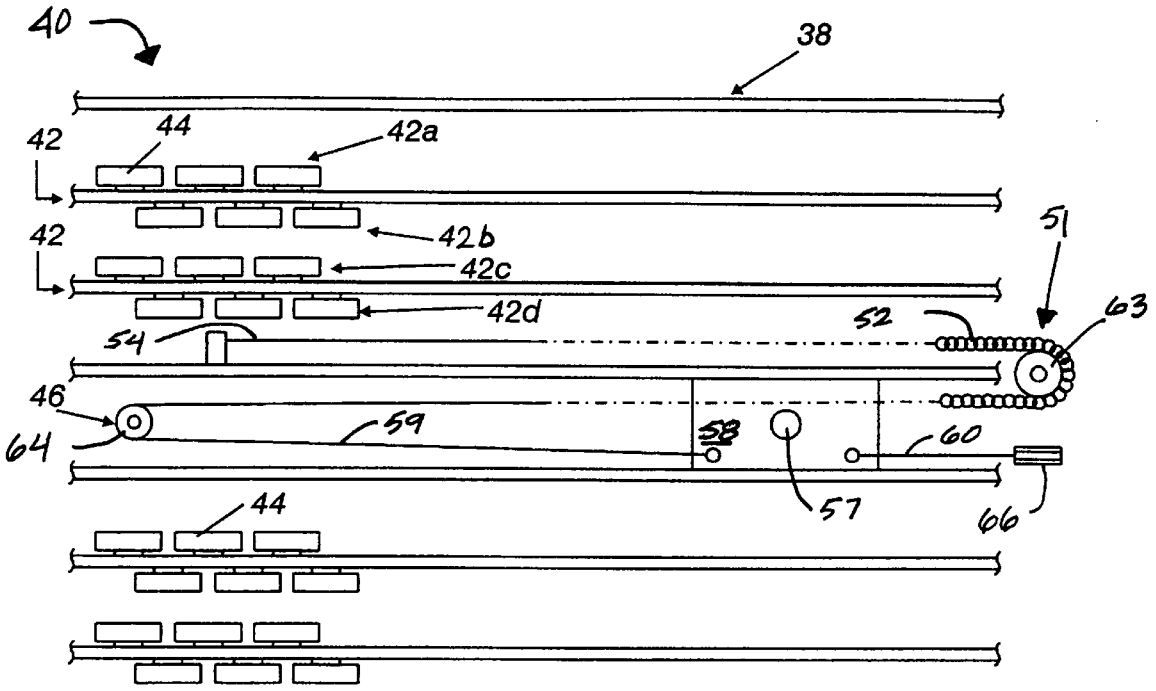
FIG. 5 is a top view of the base of a rack of the vending apparatus in accordance with the present invention.

FIG. 5 is a top view of the base of a rack of the vending apparatus in accordance with the present invention. The base 40 of the rack 38 has several lines 42 of rollers 44 for aiding the movement of articles contained within the rack 38. In a preferred embodiment, two lines of rollers, shown generally at 42*a*, 42*b*, 42*c* and 42*d*, are positioned on each side of a central channel, shown generally at 46. The rollers 44 are preferably staggered along the length of the each line 42. The rollers 44 are oriented such that adjacent rollers on adjacent lines are axially aligned. A slide 58 is movably positioned within the central channel 46 for moving the rear support plate 48 towards and away from the front door 18 and the front support plate 68.

The spring-loaded rear support plate 48 biases the set of articles S towards the front door 18 or bracket 30 of the rack 38 and the slot 34. The rear support plate 48 has openings 120 formed therethrough for receiving spikes 74 and is discussed in further detail hereinbelow. As best shown in FIG. 2, the rear support plate 48 is attached to the slide 58. In a preferred embodiment, the rear support plate includes a keyhole attachment 55 that is fixed to the posterior side of the rear support plate 48 for receiving a rod 57 mounted on the slide 58.

The movement of the rear support plate 48 is regulated by a spring/pulley mechanism, shown generally at 51 (FIG. 5). The spring/pulley mechanism includes a coil spring 52 for biasing the slide 58 and the rear support plate 48 towards the front door 18, a first wire 59 interconnecting the spring 52 and the slide 58, a second wire 60 interconnecting the slide 58 and the housing 12 and a set of pulleys 63, 64, 66.

The spring 52 is positioned in the central channel 46 and is fixed at one end 54 to the base 40 of the rack 38. The other end 56 of the spring 52 is routed around a first pulley 63 and connected to the slide 58 by the first wire 59. The first wire 59 is routed around a second pulley 64. The second wire 60 connects the slide 58 to a fixed mooring (not shown) attached to the bottom side 24 of the housing 12 and is routed around a third pulley 66.

The spring 52 and pulleys 63, 64, 66 allow the rear support plate 48 to displace away from the bracket 30 when the front door 18 is moved to the opened position and the rack 38 is pivoted upward. Similarly, when the front door 18 is moved to the closed position and the rack 38 is pivoted downward, the spring 52 and pulleys 63, 64, 66 displace the rear support plate 48 toward the bracket 30 and front support plate 68. When the front door 18 is opened and the rack 38 is pivoted upward, the slide 58 and the rear support plate 48 are drawn into the interior chamber 16 of the housing 12 by the tension of the second wire 60 which is attached to the housing 12 at the mooring. When the front door 18 is closed and the rack 38 is pivoted downward, the slide 58 and rear support plate 48 are displaced towards the bracket 30 and the front support plate 48 by the bias force of the spring 52. As the articles are dispensed, the force of the spring 52 causes the rear support plate 48 to push the remaining articles forward and against the front support plate 68 so that the front article S1 abuts the front support plate 48.

FIG. 3 is a cross-sectional side view of a portion of the vending apparatus 10 in a vending position in accordance with the present invention. FIG. 4 is a cross-sectional side view of a portion of the vending apparatus 10 in an initial vending position in accordance with the present invention. The front support plate 68 extends upwardly from the front end, shown generally at 50, of the base 40 of the rack 38 and is positioned adjacent the slot 34. The front support plate 68 contacts the bottom portion of an adjacent article S1 to hold the stack of articles S in position until they are vended. The front support plate 68 has a relatively low height to allow the vending of the adjacent article S1 discussed in further detail hereinbelow.

The dispensing means 70 comprises a lift mechanism, shown generally at 71, a pivot rod 73 (FIG. 2) coupled to the lift mechanism 71, a cam mechanism, shown generally at 94, coupled to the pivot rod 73 and the lift mechanism 71, and a handle 98 (FIG. 1) connected to the cam mechanism 94 for actuating the cam mechanism and the lift mechanism 71. The lift mechanism includes a dispensing bar 72 that is positioned between the bracket 30 and an adjacent article S1 when articles are loaded in the rack 38 and two sets of movably interconnected lift arms, shown generally at 77, attached to the ends of the dispensing bar 72. Each set of lift arms 77 is positioned on the exterior side of each side wall 31, 33 (FIG. 2). The cam mechanism comprises a cam arm 95 attached to the handle 98, a pivot arm 97 attached to the cam arm 95 and the pivot rod 73 and a pair of cams 96 mounted on the ends of the pivot rod 73, as best shown in FIG. 2.

Spikes, shown generally at 74, extend radially outward from the dispensing bar 72 for contacting and securely moving an article. In a preferred embodiment, five spikes are positioned on the dispensing bar 72. Two spikes are preferably positioned at each end of the dispensing bar 72 and a single spike is preferably positioned in the middle of the dispensing bar 72. To avoid tearing the front or adjacent newspaper S1 during loading, the dispensing bar 72 and spikes 74 are covered by a dispensing bar cover 82. The dispensing bar cover 82 is hingedly mounted to the bracket 30 and movably positioned over the dispensing bar 72.

In a preferred embodiment, an extension, shown generally at 84 (FIG. 2), is attached to the dispensing bar cover 82. The extension 84 has a roller 88 positioned at a distal end of the extension, and a corresponding side 11 of the housing 12 has a guide 92 for engaging the roller 88. When the front door 18 is in the open position, the dispensing bar cover 82 is in an article-loading position, and the dispensing bar 72 and the spikes 74 are covered by the dispensing bar cover 82. When the front door 18 is moved to a closed position, the roller 88 engages the guide 92 positioned on the side 11 of the housing 12. When the guide 92 urges the dispensing bar cover 82 to an article-engaging position, the spikes 74 are exposed and the dispensing bar 72 is free to move. A coil spring 93 is attached to the extension 84 and the rack 38 to bias the dispensing bar cover 82 over the dispensing bar 72. When the front door 18 is moved to the opened position, the guide 92 and spring 93 allow the dispensing bar cover 82 to cover the dispensing bar 72 and the spikes 74.

The dispensing bar 72 is moved by the cam mechanism 94 and lift mechanism 71 which together are activated by the handle 98. The handle 98 is pivotally mounted to the face or exterior of the front door 18. The lift mechanism 71 and the cam mechanism 94 preferably proceed through three stages as the handle 98 is pulled down or pivoted away from the front door 18. When the handle 98 is pulled down, a first stage comprises displacing the dispensing bar 72 inward and towards the interior chamber of the housing with the lift mechanism thereby allowing the spikes 74 to engage the front or adjacent article S1. As the handle 98 is drawn away or pivoted away from the front door 18, the cam arm 95 is displaced towards the front door 18, the pivot arm 97 is pivoted and each cam 96 engages one of the lift arms 77. The engaged lift arm is lifted and pivoted thereby displacing the dispensing bar 72 towards the interior 16 of the housing 12.

Figure 6:
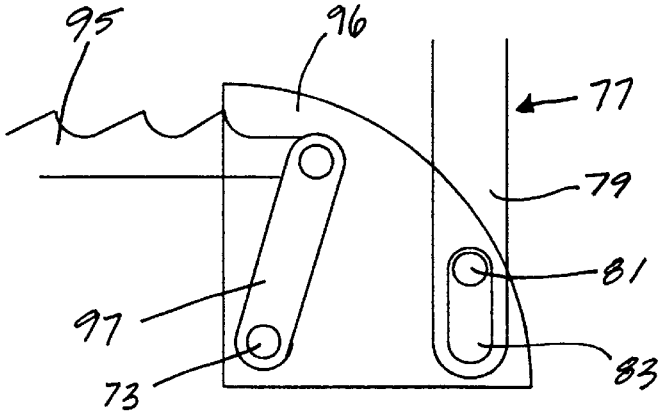
FIG. 6 is a detail view of a portion of the dispensing means of the vending apparatus as seen in FIG. 3.

FIG. 6 is a detail view of a portion of the dispensing means 70 of the vending apparatus as seen in FIG. 3. In a preferred embodiment, each cam 96 includes a lift arm pin 81 that is received in an opening 83 formed on an engaging lift arm 79. As the cam 96 is pivoted about the pivot rod 73, the lift arm pin 81 moves within the opening 83 until the pin 81 abuts the engaging lift arm 79. As the cam 96 is progressively pivoted, the cam 96 pivots the engaging lift arm 79.

Continued movement of the handle 98 causes the lift mechanism 71 to pass a second stage and displaces the dispensing bar 72 upward a distance sufficient to bring the bottom of the article above the top of the front support plate 68. In a third stage, the lift mechanism 71 displaces the dispensing bar 72 toward the front door 18 and bracket 30 thereby positioning the article over the slot 34. When the handle 98 is completely pulled down, the dispensing bar 72 abruptly displaces away from the article thereby causing the spikes 74 to release the article. The article then falls through the slot 34. Finally, as the handle 98 is released and returns to a rest position, the dispensing bar 72 returns to a rest position.

The dispensing means 70 preferably utilizes a damper 104 (FIG. 2), such as a pneumatic cylinder attached to the cam mechanism 94 and the rack 38, to slow the return of the handle 98 to the handle's initial position. Slowing the return of the handle 98 allows sufficient time for the dispensing means 70 to discharge an article through the slot 34. Additionally, the pneumatic cylinder 104 delays the return of the dispensing bar 72 and spikes 74 to their initial position so that the vended article can avoid contact with the spikes 74 and so that the spikes 74 do not pierce the next article for vending.

As best shown in FIG. 2, the discharging means 106 includes an arm 108 having a hook portion 110 at one end of the arm 108, an engaging portion 111 at the other end of the arm and a discharge bar 112 that is secured to the back of the rear support plate 48. The arm 108 is pivotally mounted on the interior surface of the bracket 30. The hook portion 110 of the arm 108 supports the display article D and prevents the display article D from falling through the slot 34 positioned below the bracket 30. The discharge bar 112 is positioned generally horizontally across the back surface 114 of the rear support plate 48 and slightly above the dispensing bar 72. The discharge bar 112 extends beyond the edge of the rear support plate 48 and is substantially aligned with the engaging portion 111. The openings or apertures 120 in the rear support plate 48 are located such that the spikes 74 on the dispensing bar 72 engage the discharge bar 112 after the set of articles S has been depleted.

During operation of the discharging means, movement of the handle 98 operates the dispensing bar 72 in the same manner as previously described. However, when there are no articles on the rack 38, the rear support plate 48 abuts the front support plate 68. As a consequence, the spikes 74 on the dispensing bar 72 displace the discharge bar 112 upward. The discharge bar 112, in turn, engages the engaging portion 111 and pivots the arm 108 to cause the hook portion 110 to pivot away from the display article D and release the display article D.

To load the invented vending apparatus 10 with articles, the first step is to unlock and open the hinged front door 18. As previously discussed, opening the front door 18 displaces the rear support plate 48 toward the interior chamber 16 of the housing 12, and the dispensing bar cover 82 covers the dispensing bar 72 and spikes 74. The articles can then be vertically stacked on the rack base 40. Next, an article is positioned in the bracket 30 such that the newspaper is displayed in the front door window 32. After the articles are positioned, the door 18 is closed. When closing the front door 18, the cover 82 uncovers the dispensing bar 72 and spikes 74, thereby exposing the spikes 74 for engagement with the front article S1. Closing the door 18 also displaces the rear support plate 48 toward the front door 18 thereby forcing the front article S1 into engagement with the dispensing means 70. Finally, the front door 18 is locked to secure the unvended articles.

The front door 18 may also include a money collection device 124 which requires that a potential purchaser deposit a predetermined amount of money before the handle 98 can be operated. Although numerous money collection devices can be employed, the invented vending apparatus 10 preferably utilizes a standard coin activated mechanism.

The invented vending apparatus includes a removable cover for protecting the components of the dispensing means and for preventing the components of the dispensing means from tearing the front article in the set of articles during the loading of the set of articles. In addition, the improved vending apparatus has means for ensuring that the dispensing means and the discharging means deliver an article each time the activation mechanism is activated. Thus, the invented vending apparatus effectively and efficiently individually vends articles such as newspapers.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

Summary of the Achievement of the Objects of the Invention

From the foregoing, it is readily apparent that we have invented an apparatus for individually vending articles. The present invention provides an apparatus having a dispensing means for individually vending an article from a set of articles and having a discharging means for vending a display article after the set of articles has been depleted. The present invention provides an article vending machine having a dispensing means for individually vending an article from a set of articles and for preventing the dispensing means from tearing an article positioned adjacent to the dispensing means during the loading of the articles. The present invention provides a newspaper vending machine having a dispensing means for individually vending a newspaper from a set of newspapers and a discharging means for vending a display newspaper after the set of newspapers has been depleted.

What is claimed is:

1. An apparatus for vending a single article from a set of articles and for vending a display article after the set of articles has been depleted, said apparatus comprising:

a housing having at least one continuous sidewall forming an interior chamber therein, said housing comprising:

a hinged door for providing access to the interior chamber of the housing; and a slot formed in said housing and positioned between said hinged door and said at least one sidewall of said housing for providing a passage through which an article is removed from the interior chamber of said housing;

a rack mounted to said hinged door and positionable within the interior chamber of said housing for holding the set of articles and advancing the set of articles towards said hinged door, said rack comprising:

a bracket mounted to an interior surface of said hinged door for positioning a display article;

means for dispensing a single article from the set of articles through said slot, said dispensing means positioned on said rack; and means for discharging a display article through said slot coupled to said rack.

2. The vending apparatus of claim 1 wherein said rack further comprises:

a base for positioning articles thereon;

a pair of opposing side walls attached to said base;

a spring-loaded rear support plate slidably engaging said base for advancing the set of articles into engagement with said dispensing means; and a front support plate attached to said base for holding the set of articles on said rack until the articles are vended.

3. The vending apparatus of claim 2 wherein said base comprises:

a roller assembly for engagement with the set of articles;

a central channel;

a slide movably positioned in said central channel for receiving said rear support plate; and a spring/pulley mechanism coupled to said base, said slide and said housing;

wherein said spring/pulley mechanism biases said rear support plate against the set of articles when said hinged door is closed and biases said rear support plate away from the set of articles when said hinged door is opened.

4. The vending apparatus of claim 2 wherein said dispensing means comprises:

three-stage lift mechanism for contacting an adjacent article in the set of articles and vending the adjacent article;

a pivot rod coupled to the lift mechanism;

a cam mechanism coupled to said pivot rod and said lift mechanism for actuating said lift mechanism; and a handle connected to said cam mechanism and pivotally connected to said hinged door.

5. The vending apparatus of claim 4 wherein said lift mechanism comprises:

a dispensing bar positioned between said bracket of said rack and the adjacent article, said dispensing bar having at least one spike extending radially from said dispensing bar; and a pair of sets of lift arms connected to the ends of said dispensing bar, each of said pair of sets of lift arms pivotally attached to one of said pair of opposing side walls of said rack.

6. The vending apparatus of claim 5 wherein said dispensing means further comprises a hinged dispensing bar cover attached to said bracket of said rack for covering said dispensing bar and said at least one spike, said dispensing bar cover movable between an article-loading position and an article engagement position;

wherein positioning said cover in the article-loading position covers said dispensing bar and said at least one spike; and wherein positioning said cover in the article-engagement position exposes said at least one spike and frees said dispensing bar thereby permitting said at least one spike to engage the adjacent article in the set of articles.

7. The vending apparatus of claim 6 wherein said dispensing bar cover comprises an extension fixedly attached to one end of said dispensing bar cover; wherein said housing further comprises a guide attached to said at least one side wall of said housing for guiding said extension; and, wherein moving said door from an opened position to a closed position causes said extension to engage said guide thereby moving said dispensing bar cover to the article-engaging position.

8. The vending apparatus of claim 7 wherein said dispensing means further comprises a coil spring interconnecting said extension of said dispensing bar cover and one of said pair of opposing side walls of said rack, said coil spring biasing said dispensing bar cover over said dispensing bar and said at least one spike; and, wherein moving said door from a closed position to an opened position causes said extension to disengage from said guide thereby moving said dispensing bar cover to the article-loading position.

9. The vending apparatus of claim 5 wherein said cam mechanism comprises:

a cam arm attached to said handle;

a pivot arm connected to said cam arm and said pivot rod; and a pair of cams attached to said pivot rod and positioned substantially proximal to the ends of said pivot rod, said pair of cams for actuating said lift mechanism in stages.

10. The vending apparatus of claim 9 wherein each of said pair of cams comprises a pin for engaging said lift mechanism; and wherein each of said pair of sets of lift arms comprises an engaging lift arm having an opening formed therethrough for receiving said pin of each of said pair of cams.

11. The vending apparatus of claim 5 wherein pivoting said handle progressively away from said door first displaces said dispensing bar to engage the adjacent article in the set of articles, then displaces said dispensing bar upward thereby displacing the adjacent article above said front support plate, then displaces said dispensing bar toward said door thereby positioning the first article over said slot, then abruptly displaces said dispensing bar toward said door thereby causing said dispensing bar to release the adjacent article through said slot.

12. The vending apparatus of claim 5 wherein said discharging means comprises:

an arm pivotally mounted on said bracket, said arm comprising:

a hook portion positioned on a first end of the arm for releasably supporting the display article; and an engaging portion positioned on a second end of the arm; and a discharge bar movably positioned on said rear support plate for engaging said engaging portion after the set of articles has been depleted;

wherein said engaging portion and said discharge bar are substantially aligned with each other.

13. The vending apparatus of claim 12 wherein said discharge bar is horizontally positioned on a back surface of said rear support plate; and, wherein said rear support plate has at least one aperture for receiving said at least one spike on said dispensing bar, said at least one aperture aligned with said at least one spike on said dispensing bar.

14. The vending apparatus of claim 13 wherein pivoting said handle progressively away from said door after the set of articles has been depleted first causes said at least one spike on said dispensing bar to engage said discharge bar through said at least one aperture; wherein movement of said discharge bar causes said engaging portion to pivot; and, wherein movement of said receiver causes said hook portion of said arm to release the display article through said slot.

15. The vending apparatus of claim 5 further comprising a damper attached to said cam mechanism for slowing the return motion of said dispensing bar and providing sufficient time for a single article to be vended through said slot.

16. The vending apparatus of claim 15, wherein said damper is a pneumatic cylinder.

17. The vending apparatus of claim 4 further comprising:

a money collection device attached to said hinged door, whereby inserting a pre-determined sum of money into said money collection device allows a purchaser to displace said handle to a vending position for operating said dispensing means and for operating said discharging means after the set of articles has been depleted.

18. The vending apparatus of claim 1 wherein said hinged door comprises a partially transparent window for providing a view of the display article.

19. The vending apparatus of claim 1 wherein said housing further comprises a catch attached to said housing for receiving a vended article after the vended article has exited said interior chamber of said housing.

* * * * *